US009059537B2

(12) United States Patent
Peuchet et al.

(10) Patent No.: US 9,059,537 B2
(45) Date of Patent: Jun. 16, 2015

(54) SPLIT LOCK NUT FOR BUNDLED WIRE CONNECTOR

(75) Inventors: Pascal Peuchet, Ste Colombe la Commanderie (FR); Laurent Houry, Le Roncenay-Authenay (FR)

(73) Assignee: CONNECTEURS ELECTRIQUES DEUTSCH, Evreux (FR)

( * ) Notice: Subject to any disclaimer, the term of this patent is extended or adjusted under 35 U.S.C. 154(b) by 0 days.

(21) Appl. No.: 13/985,055

(22) PCT Filed: Mar. 7, 2012

(86) PCT No.: PCT/EP2012/053930

§ 371 (c)(1),
(2), (4) Date: Aug. 13, 2013

(87) PCT Pub. No.: WO2012/120049

PCT Pub. Date: Sep. 13, 2012

(65) Prior Publication Data

US 2013/0316574 A1 Nov. 28, 2013

(30) Foreign Application Priority Data

Mar. 8, 2011 (FR) ..... 11 51863

(51) Int. Cl.

| | |
|---|---|
| ***H01R 13/60*** | (2006.01) |
| ***H01R 13/58*** | (2006.01) |
| ***H01R 13/595*** | (2006.01) |
| ***H01R 43/00*** | (2006.01) |

(52) U.S. Cl.

CPC ..... *H01R 13/5804* (2013.01); *Y10T 29/49208* (2015.01); *H01R 13/5812* (2013.01); *H01R 13/595* (2013.01); *H01R 43/00* (2013.01)

(58) Field of Classification Search

USPC ..... 439/574, 98, 99, 462, 470; 411/385; 174/650, 656, 657

IPC . H01R 13/59,13/5841, 13/5804; H02G 3/0666, H02G 15/02

See application file for complete search history.

(56) References Cited

U.S. PATENT DOCUMENTS

| | | | | |
|---|---|---|---|---|
| 5,018,987 | A | 5/1991 | Kirma | |
| 5,406,032 | A * | 4/1995 | Clayton et al. | 174/151 |
| 5,620,334 | A | 4/1997 | Quillet et al. | |
| 5,929,383 | A * | 7/1999 | Marik et al. | 174/78 |
| 6,196,865 | B1 | 3/2001 | Ruffel et al. | |
| 7,338,312 | B2 * | 3/2008 | Herth | 439/461 |
| 7,915,545 | B1 * | 3/2011 | Bixler et al. | 174/664 |
| 2004/0177989 | A1 * | 9/2004 | Nass et al. | 174/65 SS |
| 2009/0025977 | A1 * | 1/2009 | Anderson et al. | 174/653 |

FOREIGN PATENT DOCUMENTS

| | | |
|---|---|---|
| EP | 0 685 908 | 12/1995 |
| FR | 2 770 041 | 4/1999 |
| GB | 2 149 234 | 6/1985 |

OTHER PUBLICATIONS

International Search Report dated May 31, 2012, corresponding to PCT/EP2012/053930.

* cited by examiner

*Primary Examiner* — Vanessa Girardi
(74) *Attorney, Agent, or Firm* — Young & Thompson

(57) ABSTRACT

An electric connector accessory for a bundle of conductor wires, constituted by an accessory body (2) and by a nut (3). The nut is constituted by two half-nuts (15, 16) that are separated by an axial plane and that can be assembled together by clip-fastening, and the accessory body (2) is suitable for being applied laterally against the bundle of wires, and for being held by locking the nut (3) onto the connector.

3 Claims, 2 Drawing Sheets

SPLIT LOCK NUT FOR BUNDLED WIRE CONNECTOR

BACKGROUND OF THE INVENTION

1. Field of the Invention

The invention relates to an electric connector accessory and to its method of assembly.

2. Description of the Related Art

In general, an electric connector comprises, for each of its two portions, a connector body provided with an outside thread for receiving a locking nut, and inside the body of the connector, a connection base for receiving the conductor wires. The connector is wired by crimping contacts onto the conductor wires and inserting the contacts into the base.

In order to be able to put the locking nut into place on the connector body, it is necessary for the bundle of wires to be threaded through the nut before performing the operations of crimping and inserting the contacts. Furthermore, if action needs to be taken on some of the wires, it is necessary to undo the wiring of the bundle and subsequently to retest all of the wires.

Document FR 2 770 041 describes a removable coupling for an electric connector, the coupling being constituted by a collar comprising at least two portions and by a nut comprising two hinged-together portions. In order to be assembled, that structure requires a pin and a certain number of half-flanges and screws, thereby constituting a corresponding number of parts for putting into place during assembly, which requires time and skill.

BRIEF SUMMARY OF THE INVENTION

One of the objects of the invention is to provide an electric connector accessory that is particularly simple to put into place, and that enables actions to be taken without requiring the wiring of the bundle to be undone.

Another object of the invention is to provide an electric connector accessory that enables the wires or the bundle to be grounded in simple manner.

Yet another object of the invention is to provide an electric connector accessory that does not require the wires to be passed through the locking nut as a preliminary.

The invention provides an electric connector accessory for a bundle of electric wires, the accessory being constituted by an accessory body and by a nut, the nut being constituted by two half-nuts that are separated by an axial plane, the accessory body being suitable for being applied laterally against the bundle of wires, and for being held by locking the nut on the connector, characterized in that firstly the accessory body presents a laterally-open ring of generally cylindrical shape, and secondly the two half-nuts are suitable for assembling together by clip-fastening.

In advantageous manner, the accessory body is made as a single piece.

Advantageously, the accessory body is constituted by two half-shells together constituting a cylindrical sheath for the bundle of wires.

In advantageous manner, the accessory body presents a grounding lug.

Advantageously, the side opening of the ring enables the accessory body to be put into place on the bundle by a lateral approach after the wires of the bundle have been wired to the connector.

The invention also provides a method of assembling an electric connector accessory on a bundle of conductor wires, the method being characterized by the steps of:

wiring the wires of the bundle to the connector;

putting the accessory body into place on the bundle by a lateral approach;

putting the two half-nuts into place on either side of the bundle and connecting them together by clip-fastening; and sliding the nut as constituted in this way onto the accessory body and screwing it onto the connector body in order to lock it.

In advantageous manner, the method includes the additional step of:

connecting the ground of the bundle to the lug of the accessory body in order to provide grounding.

BRIEF DESCRIPTION OF THE DRAWINGS

Other objects, characteristics, and advantages invention appear from the following description made by way of non-limiting example and with reference to the accompanying drawings, in which.

DETAILED DESCRIPTION OF THE PREFERRED EMBODIMENTS

Figure 1:
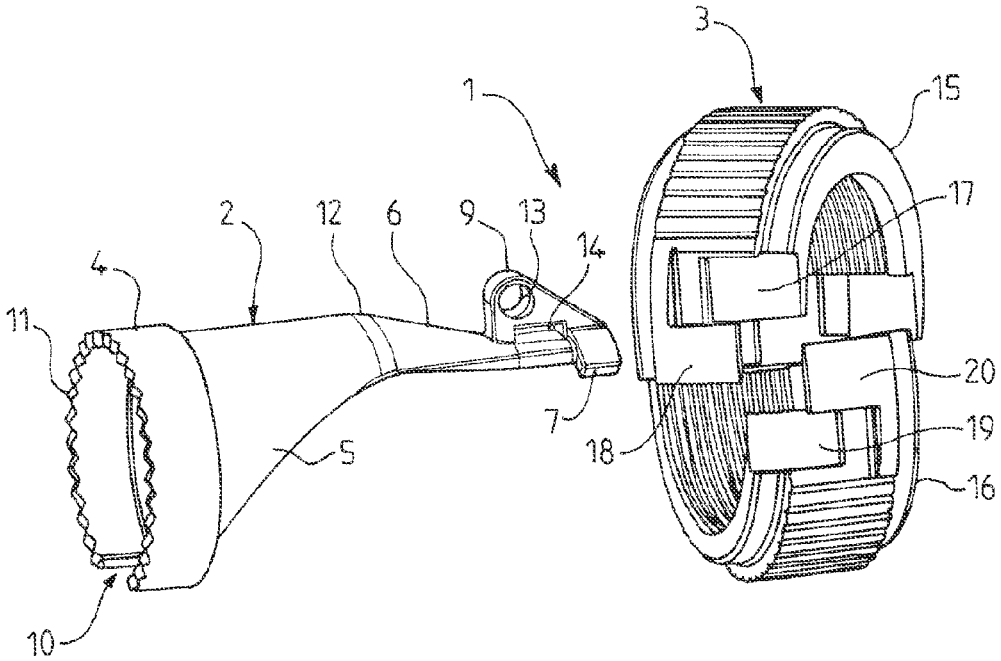
FIG. 1 is a perspective view of a first embodiment of the electric connector accessory of the invention, prior to being assembled.

In the drawings, the electric connector accessory 1 is made up of an accessory body 2 and a nut 3. The accessory body 2 comprises a ring 4, a skirt 5, and a rear portion 6 carrying two fins 7, 8, and a lug 9. The ring 4 is generally cylindrical in shape, and it presents a side opening 10, and a crenellated free edge 11. The skirt 5 has a cylindrical surface about the same axis as the ring 4. It extends from the edge of the ring 4 opposite from its free edge 11 to a bow-shaped portion 12 connecting it to the rear portion 6. In the embodiment of FIG. 1, the accessory body 2 is made as a single piece.

In the embodiment shown, the side opening 10 corresponds to a circular arc of about 20° to 30°, and the bow-shaped portion 12 to an arc of about 50° to 60°. The skirt 5 thus tapers from the ring 4 to the bow-shaped portion 12. The rear portion 6 extends beyond the bow-shaped portion 12, tapering a little and sloping towards the axis that is common to the ring 4 and to the skirt 5. Its free end is cylindrical and is extended on either side by the fins 7, 8. The lug 9 is arranged radially, outwards from the rear portion 6, in the vicinity of its free end. It presents a connection orifice 13. Between the rear portion 6 and the lug 9 there is provided a slot 14 suitable for receiving a tie or a strap, for example.

The nut 3 is made up of two half-nuts 15 and 16 that are separated by an axial plane and that are suitable for being assembled together by clip fastening during a relative movement. At its front end that can be seen in FIG. 1, the half-nut 15 presents a notch 17 and an arm 18. In analogous manner, at its front end that is visible in FIG. 1, the half-nut 16 presents a notch 19 and an arm 20. At their rear ends, the two half-nuts 15 and 16 present notches and arms in identical arrangements.

Figure 3:
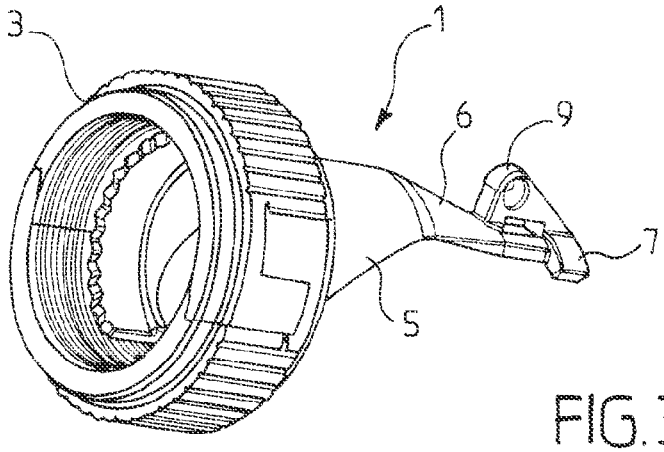
FIG. 3 is a perspective view of the FIG. 1 electric connector accessory after being assembled.
Figure 4:
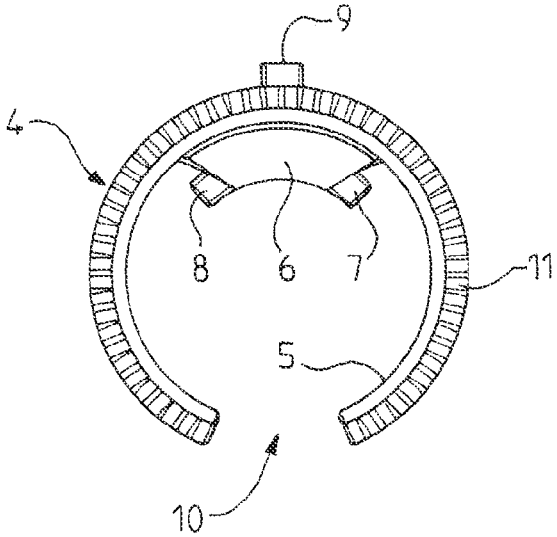
FIG. 4 is an end face view of the body of the FIG. 1 electric connector accessory.
Figure 5:
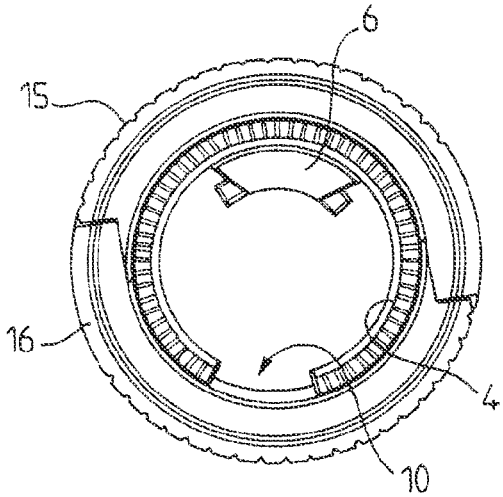
FIG. 5 is an end face view of the FIG. 3 electric connector accessory.

When they are offset as shown in FIG. 1, the two half-nuts may be moved towards each other until the free edges of their notches 17 and 19 come into contact. Relative movement of the two half-nuts 15 and 16 then enables the nut 3 to be made up: the arm 20 of the half-nut 16 slides in the notch 17 of the half-nut 15, simultaneously the arm 18 of the half-nut 15 slides in the notch 19 of the half-nut 16, and at the end of the movement, both half-nuts are assembled together by clip fastening. The nut 3 is then made up, as shown in FIG. 3. By relative movement in opposite directions, the two half-nuts 15 and 16 can be separated.

Figure 2:
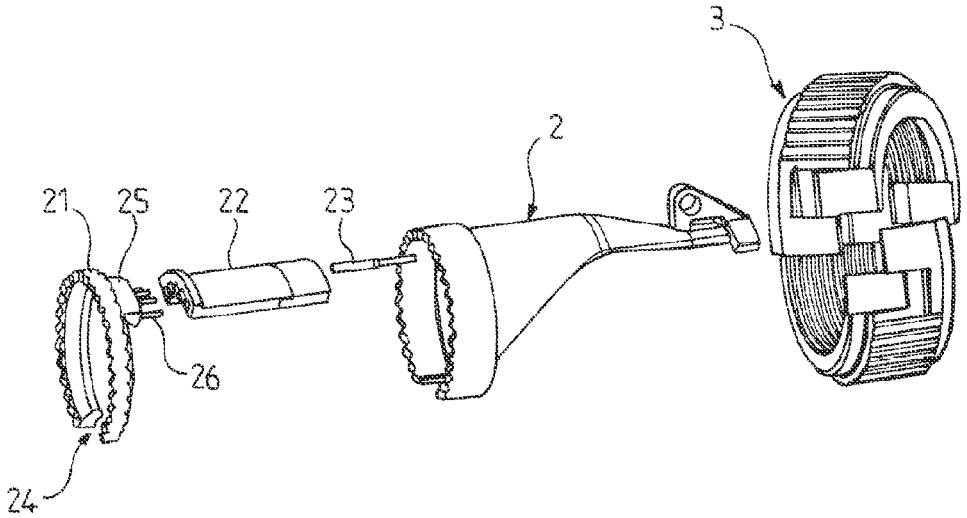
FIG. 2 is a view analogous to FIG. 1 of a second embodiment of the electric connector accessory of the invention, prior to being assembled.

In the embodiment of FIG. 1, grounding is provided by the lug 9. In the embodiment of FIG. 2, grounding is provided by contacts for crimping, and where appropriate, by the lug 9. In the embodiment of FIG. 2, the electric connector accessory 1 also presents a grounding ring 21 that has a side opening 24 corresponding to the side opening 10 in the ring 4. This ring 21 has a crenellated rear edge for co-operating with the crenellated free edge 11 of the ring 4, and it also has a crenellated front edge. Towards the rear, it carries an arcuate portion 25. This arcuate portion 25 is of diameter that is smaller than that of the ring 21, and towards the rear it carries a series of contacts 26 for penetrating into channels of an insulating subassembly 22 that is pierced longitudinally by said channels. The insulating subassembly 22 extends over a fraction of the cylindrical surface that is to be received under the skirt 5. Contacts 23 may be inserted into these channels via the rear end that is accessible under the skirt 5.

In the embodiment of FIG. 1, the electric connector accessory 1 is assembled in the following manner. Firstly, a contact is crimped onto each of the conductor wires of the bundle of wires for connecting to the connector, with this contact being inserted into the base of the connector. The accessory body 2 is put into place on the bundle by inserting all of the wires of the bundle through the opening 10 of the ring 4. The two half-nuts 15 and 16 are moved towards each other about the bundle, and they are moved so as to be fastened together by clip-fastening. The nut 3 as made up in this way is slid over the bundle and over the accessory body 2, and it is screwed onto the body of the connector in order to lock it. Finally, the shielding of the bundle is connected to the grounding lug 9.

In the embodiment of FIG. 2, after the contact has been crimped and inserted into the base of the connector, the grounding ring 21, the insulating subassembly 22, and the accessory body 2 are put into place on the bundle of wires. The ring 21 and the insulating subassembly 22 are secured to each other by inserting contacts 26 into the channels of the insulating subassembly 22. The accessory body 2 is slid over the insulating subassembly 22 until making contact with the ring 21. The two half-nuts 15 and 16 are put into place on the bundle and assembled together. The nut 3 is slid over the accessory body 2 and locked onto the connector. The contacts 23 are crimped onto the grounding wires, and then they are inserted into the channels of the insulating subassembly 22.

Thus, in the embodiments of FIGS. 1 and 2, the connector accessory is installed on the bundle of wires by means of a lateral approach.

The invention is described above with reference to particular embodiments, to which it is not limited. The invention covers all techniques that are equivalent to the means described and all combinations thereof that come within the ambit of the invention.

The invention claimed is:

1. An electric connector accessory for a bundle of electric wires, the accessory comprising:

an accessory body configured to be applied laterally against the bundle of wires; and a nut, the nut being constituted by two half-nuts that are separated by an axial plane, wherein the accessory body is configured to be held by locking the nut wherein the accessory body is a single piece and presents a laterally-open ring of generally cylindrical shape, and the two half-nuts are configured to be assembled together by clip-fastening.

2. The electric connector accessory according to claim 1, wherein the laterally-open ring includes an opening sized to receive the bundle of wires.

3. A method of assembling an electric connector accessory, the method comprising:

putting an accessory body of the electric connector assembly into place on a bundle of conductor wires by a lateral approach;

putting the two half-nuts that are separated by an axial plane and that constitute a nut of the electric connector assembly into place on either side of the bundle and connecting the two half-nuts together by clip-fastening; and sliding the connected nut onto the accessory body in order to lock the connected nut, wherein the accessory body is a single piece and presents a laterally-open ring of generally cylindrical shape.

* * * * *